US008334487B2

(12) United States Patent
Ohashi et al.

(10) Patent No.: US 8,334,487 B2
(45) Date of Patent: Dec. 18, 2012

(54) INDUCTION HEATING COOKING DEVICE

(75) Inventors: Masaharu Ohashi, Hyogo (JP); Kenji Watanabe, Nara (JP); Hiroshi Tominaga, Hyogo (JP); Shintaro Noguchi, Hyogo (JP); Tomoya Fujinami, Hyogo (JP)

(73) Assignee: Panasonic Corporation, Osaka (JP)

( * ) Notice: Subject to any disclaimer, the term of this patent is extended or adjusted under 35 U.S.C. 154(b) by 1074 days.

(21) Appl. No.: 12/278,696

(22) PCT Filed: Feb. 7, 2007

(86) PCT No.: PCT/JP2007/052125

§ 371 (c)(1),
(2), (4) Date: Aug. 7, 2008

(87) PCT Pub. No.: WO2007/091597

PCT Pub. Date: Aug. 16, 2007

(65) Prior Publication Data

US 2009/0014438 A1 Jan. 15, 2009

(30) Foreign Application Priority Data

Feb. 7, 2006 (JP) ..... 2006-029376

(51) Int. Cl.
*H05B 6/12* (2006.01)

(52) U.S. Cl. ..... 219/627; 219/620; 219/667

(58) Field of Classification Search ..... 219/620–627, 219/667, 711, 494; 99/325, 451
See application file for complete search history.

(56) References Cited

U.S. PATENT DOCUMENTS

| | | | | |
|---|---|---|---|---|
| 5,428,207 | A * | 6/1995 | Essig et al. | 219/622 |
| 7,473,872 | B2 | 1/2009 | Takimoto | |
| 2004/0099652 | A1 * | 5/2004 | Berkcan et al. | 219/448.11 |
| 2007/0080158 | A1 * | 4/2007 | Takimoto | 219/627 |

FOREIGN PATENT DOCUMENTS

| | | | |
|---|---|---|---|
| CN | 2422904 | | 3/2001 |
| JP | 3-208288 | | 9/1991 |
| JP | 2003-38347 | | 2/2003 |
| JP | 2003-109736 | | 4/2003 |
| JP | 2003109736 | A * | 4/2003 |
| JP | 2003-317916 | | 11/2003 |
| JP | 2004-63199 | | 2/2004 |
| JP | 2005-11618 | | 1/2005 |
| WO | WO 2005/053362 | | 6/2005 |
| WO | WO 2005053362 | A1 * | 6/2005 |

* cited by examiner

*Primary Examiner* — Henry Yuen
*Assistant Examiner* — Jianying Atkisson
(74) *Attorney, Agent, or Firm* — Hamre, Schumann, Mueller & Larson, P.C.

(57) ABSTRACT

An induction heating cooking device includes a heating coil (8) that induction-heats a cooking container, an infrared sensor (10) that detects infrared radiation which is emitted from a bottom surface of the cooking container and that outputs a detection signal based on the quantity of energy of the detected infrared radiation, and a heating control section (9) that controls supply of electric power to the heating coil based on the detection signal. When the temperature of the bottom surface of the cooking container is equal to or higher than a first predetermined temperature which is higher than 230 degrees C., the infrared sensor (10) outputs the detection signal, and when the bottom-surface temperature is lower than the first predetermined temperature, the infrared sensor (10) does not output the detection signal substantially.

7 Claims, 2 Drawing Sheets

INDUCTION HEATING COOKING DEVICE

TECHNICAL FIELD

The present invention relates to an induction heating cooking device for use in general homes, restaurants, offices and the like.

BACKGROUND ART

In recent years, there has been widespread use of induction heating cooking devices for induction-heating objects to be heated such as pans, using heating coils. Such induction heating cooking device is provided with a heat sensitive element such as a thermistor, on the lower surface of a top plate, so that the output of the heating coil is controlled based on the temperature of a pan which is detected through the top plate (hereinafter, referred to as a "detected temperature"), in order to prevent the occurrence of ignition of oil due to rises of the temperature of the oil within the pan. For example, a heating cooking device of a patent document 1 compares a detected temperature with a control temperature which has been preliminarily set according to the output of a heating coil, and controls such that the output of the heating coil is reduced when the detected temperature exceeds the control temperature. Further, in order to prevent the ignition of oil without degrading the cooking performance, the value of the control temperature set preliminarily according to the output of the heating coil is changed according to the increase or decrease of the detected temperature, such that the value of the control temperature is set to 185 degrees C. and 203 degrees C. when the output of the heating coil is 2000 W and 1450 W, respectively.

Patent Document 1: JP 2003-38347 A

DISCLOSURE OF INVENTION

Problems to be Solved by the Invention

It takes time to transfer heat from the pan to the top plate, which prevents the thermistor which detects the temperature of the pan through the top plate from following abrupt changes of the temperature. Particularly, when a small amount of oil is heated, such as in cases of cooking for sauteed foods, the oil temperature abruptly rises, which prevents the detected temperature from following the actual oil temperature, thereby inducing the problem of a large difference between the oil temperature and the detected temperature. Therefore, there has been a need for setting the control temperature to be significantly lower than the actual oil temperature, in order to prevent the occurrence of ignition of oil, which has caused the control temperature to be rapidly reached, thereby making it impossible to perform cooking for a long time by heating, in cases of cooking with higher firepower. As described above, the induction heating cooking devices have not been suitable for cooking for sauteed foods and the like, since they have had poor detection sensitivity to higher temperatures in cases of using a small amount of oil.

The present invention is intended for overcoming the conventional problems and aims at providing an induction heating cooking device capable of having increased detection sensitivity to the temperature of the bottom surface of a cooking container when this temperature is higher in cases of using a small amount of oil and, also, capable of preventing reduction of the heating output in cases of cooking at relatively lower temperatures such as in cases of cooking for boiled foods and oily fried foods.

Means for Solving the Problems

An induction heating cooking device according to the present invention includes: a top plate that is partially or entirely made of a material capable of transmitting infrared radiation, a cooking container being placed on the top plate; a heating coil that induction-heats the cooking container; an infrared sensor that detects infrared radiation which is emitted from a bottom surface of the cooking container faced to the heating coil and is passed through the top plate and that outputs a detection signal based on the quantity of energy of the detected infrared radiation; and a heating control section that controls supply of electric power to the heating coil by flowing a high-frequency electric current through the heating coil based on the temperature of the bottom surface of the cooking container which is detected by the detection signal; wherein, when the temperature of the bottom surface of the cooking container is equal to or higher than a first predetermined temperature which is higher than 230 degrees C., the infrared sensor outputs the detection signal having output values increasing as the bottom-surface temperature increases, and when the bottom-surface temperature is lower than the first predetermined temperature, the infrared sensor does not output the detection signal substantially, and the heating control section reduces or stops the electric power supplied to the heating coil when the bottom-surface temperature is equal to or higher than a second predetermined temperature which is higher than the first predetermined temperature and is lower than an ignition temperature of oil.

The induction heating cooking device may further include a temperature detection section that detects the temperature of the bottom surface of the cooking container, through a heat sensitive element which receives heat transferred from an underside surface of the top plate. When the infrared sensor is outputting the detection signal, the heating control section may control the supply of electric power to the heating coil based on the temperature of the bottom surface of the cooking container according to the infrared sensor, and when the infrared sensor is not outputting the detection signal, the heating control section may control the supply of electric power to the heating coil, such that the temperature of the bottom surface of the cooking container according to the temperature detection section is lower than a third predetermined temperature.

The first predetermined temperature is, for example, 250 degrees C. In cases of cooking for fried foods, the used oil temperature is at most 230 degrees C. and, therefore, the infrared sensor outputs no detection signal. This can prevent reduction of the heating output based on the detection signal from the infrared sensor, in cases of cooking for fried foods. Since the detection signal from the infrared sensor come up at 250 degrees C., it is possible to increase the detection sensitivity to higher temperatures equal to or higher than 250 degrees C., in cases of using a small amount of oil, such as in cases of cooking for sauteed foods generally at temperatures in the range of 200 to 300 degrees C.

The second predetermined temperature is, for example, 300 degrees C. This enables suppressing the heating output while providing a sufficient margin with respect to a normal oil ignition temperature of about 330 degrees C., even in cases of using a small amount of oil, thereby stably preventing the ignition of oil.

The induction heating cooking device may further include a state display section that indicates whether the infrared sensor is outputting the detection signal, using light or a liquid crystal. Further, the induction heating cooking device may further include an informing section which, when the infrared sensor is outputting the detection signal, informs of the fact.

This can realize an induction heating cooking device with higher safety and higher usability.

The infrared sensor can be a silicon photodiode. This enables increasing the detection sensitivity with an inexpensive structure.

Effects of the Invention

With the induction heating cooking device according to the present invention, it is possible to increase the detection sensitivity to the temperature of the bottom surface of a cooking container when the temperature of the bottom surface of the cooking container is higher in cases of using a small amount of oil and, also, it is possible to prevent reduction of the heating output in cases of cooking at relatively lower temperatures, such as in cases of cooking for boiled foods and oily fried foods.

More specifically, the infrared sensor starts outputting a detection signal when the temperature of the bottom surface of the cooking container is equal to or higher than the first predetermined temperature which is higher than 230 degrees C., which enables the heating control section 9 to determine, accurately, temperatures around the second predetermined temperature (for example, 300 degrees C.) which is lower than the ignition temperature of oil, without increasing the range of detection. When the temperature of the bottom surface of the cooking container is equal to or higher than the first predetermined temperature, the detection signal is changed more largely than that of when the temperature of the bottom surface is smaller than the first predetermined temperature and also is close to the first predetermined temperature, which enables detection of temperatures around the second predetermined temperature, with excellent followability and accuracy. In cases of using a small amount of oil which causes abrupt changes in the temperature of the bottom surface of the cooking container, the temperature of the bottom surface detected by the infrared sensor with high followability has a value close to the actual oil temperature. Accordingly, by performing heating control based on the infrared sensor with the aforementioned structure, it is possible to prevent, with higher accuracy, the ignition of oil within the cooking container, even in cases of cooking for sauteed foods by heating with high firepower.

On the other hand, in cases of using a large amount of oil, usually, the cooking container is heated at a state where its bottom surface is at a temperature of 230 degrees C. or less. Since the first predetermined temperature is set to be higher than 230 degrees C., the infrared sensor outputs no detection signal, in this case. This can prevent the heating output from being unintentionally suppressed by variations and the like in the output from the infrared sensor, thereby enabling stable heating control. When the amount of oil is greater, the temperature gradient is more moderate, which enables concomitantly using a heat sensitive element based on heat transfer, such as a conventional thermistor, as required. Even in this case, it is possible to determine the temperature of the cooking container with sufficiently higher accuracy, utilizing the temperature detected through reception of heat from the top plate. This enables heating control with a simple structure and with lower cost. For example, it is possible to perform heating control suitable for fried foods. Further, even when the amount of oil is smaller, when the difference between the temperature based on a heat receiving element such as a thermistor and the temperature of the to-be-heated object has been reduced, such as in a stable state, it is possible to adjust the temperature of the to-be-heated object to a predetermined temperature, using the heat receiving element.

DESCRIPTION OF REFERENCE CHARACTERS

Figure 1:
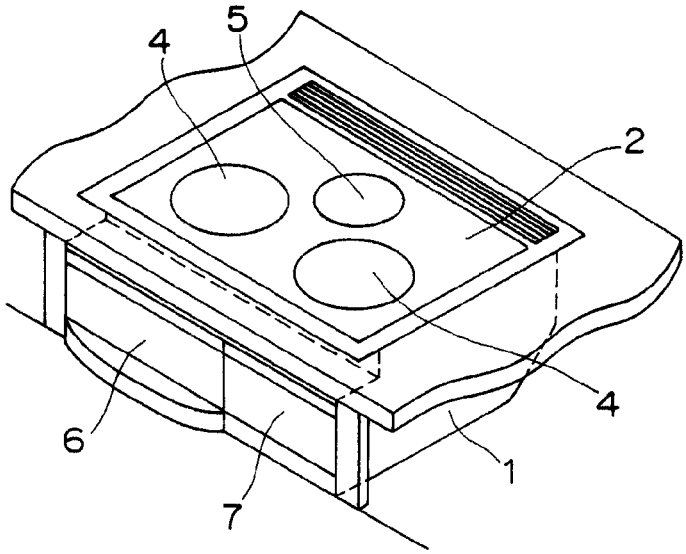
FIG. 1 is a perspective view of an induction heating cooking device according to an embodiment of the present invention.

1: Outer case
2: Top plate
3: Cooking container
8: Heating coil
9: Heating control section
10: Infrared sensor
11: Temperature detection section
12: Infrared temperature conversion section
13: State display section
14: Informing section
15: Thermistor

BEST MODE FOR CARRYING OUT THE INVENTION

Hereinafter, an embodiment of the present invention will be described, with reference to the drawings.

[Structure of Induction Heating Cooking Device]

Figure 2:
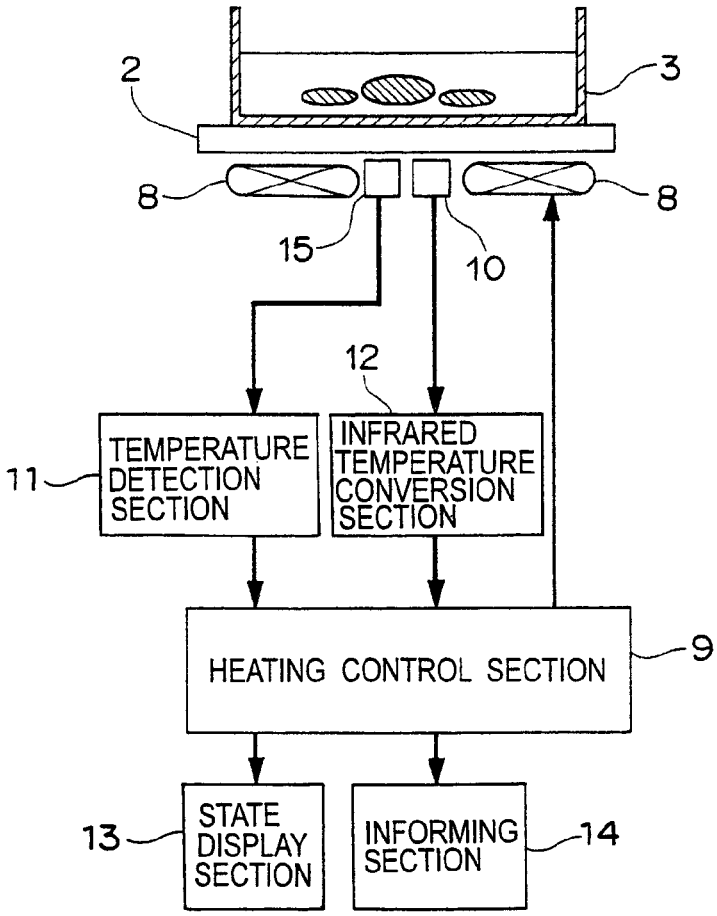
FIG. 2 is a block diagram of the induction heating cooking device according to the embodiment of the present invention.

FIG. 1 and FIG. 2 illustrate the structure of an induction heating cooking device according to an embodiment of the present invention. The induction heating cooking device according to the present embodiment includes an outer case 1, and a top plate 2 provided on the upper section of the outer case 1. On the upper surface or the lower surface of the top plate 2, there are displayed heating sections 4 and 5 indicative of positions at which a cooking container 3 such as a pan is to be placed, through printing. Under the heating section 4, there is provided a heating coil 8 for heating the cooking container 3 through induction heating. Under the heating section 5, there is provided a radiant heater which applies radiant heating to the cooking container. Further, in the front side of the outer case 1, there are provided a roaster 6 for roasting fish and the like, and an operating section 7 including switches for starting/stopping heating and for controlling the increase and decrease of the firepower.

The cooking container 3 is placed on the upper surface of the top plate 2 such that it aligns with the heating coil 8. A thermistor 15 as a heat sensitive element is provided such that it contacts with the lower surface of the top plate 2, at the upper position inside of the center opening section of the heating coil 8. A temperature detection section 11 receives heat, through the thermistor 15, from the back surface of the top plate 2 to detect the temperature of the cooking container 3 (hereinafter, referred to as a "detected temperature") and then outputs the detected temperature.

Further, the top plate 2 is partially or entirely made of a material capable of transmitting infrared radiation therethrough, and an infrared sensor 10 is provided under the top plate 2. The infrared radiation emitted from the portion at the bottom surface of the cooking container 3 enters an infrared-radiation incidence area provided in the top plate 2, then passes through a tubular-shaped optical guiding tube (not illustrated) provided between the top plate 2 and the infrared sensor 10 and, then, is received by the infrared sensor 10. The infrared sensor 10 receives the infrared radiation emitted from the portion at the bottom surface of the cooking container 3 near and above the center of the heating coil 8. The infrared sensor 10 detects the received infrared radiation and outputs a detection signal based on the quantity of energy of the detected infrared radiation. An infrared temperature conversion section 12 converts the detection signal outputted from the infrared sensor 10 into a temperature of the bottom surface of the cooking container 3 (hereinafter, referred to as an "infrared temperature") and then outputs the converted detection signal. The infrared temperature resulted from the conversion by the infrared temperature conversion section 12 is outputted to a heating control section 9 provided under the heating coil 8.

Figure 3:
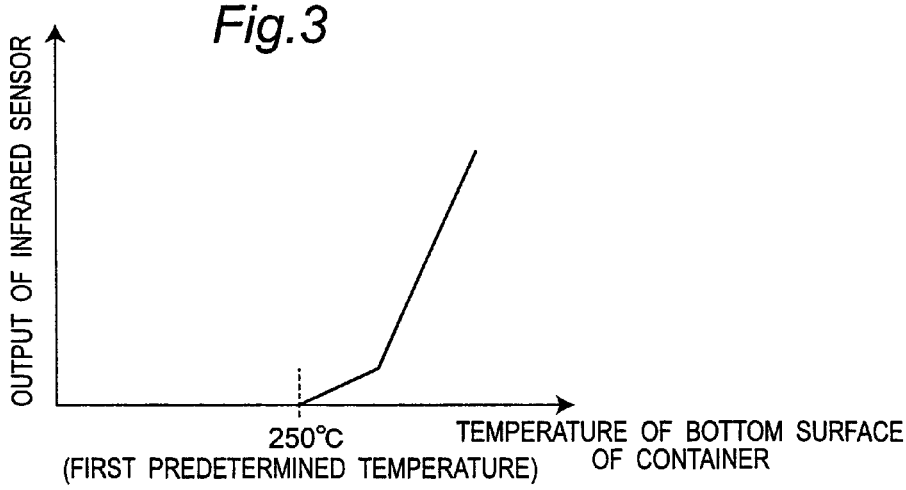
FIG. 3 is a characteristic diagram of an infrared sensor according to the embodiment of the present invention.

The infrared sensor 10 according to the present embodiment is constituted by a light receiving element constituted by a silicon photodiode which detects infrared radiation emitted from the cooking container 3, and an amplifier which amplifies the quantity of energy of the infrared radiation detected by the light receiving element for creating a detection signal. FIG. 3 illustrates a characteristic of a detection signal outputted from the infrared sensor 10. The infrared sensor 10 outputs a detection signal when the temperature of the bottom surface of the cooking container 3 is equal to or higher than a first predetermined temperature, but outputs no detection signal when the temperature of the bottom surface of the cooking container 3 is lower than the first predetermined temperature. In this case, the meaning of the terms "the infrared sensor 10 outputs no detection signal" includes not only cases where the infrared sensor 10 does not output the detection signal at all, but also cases where the infrared sensor 10 outputs the detection signal which can not enable the heating control section 9 to read the temperature change at the bottom surface of the cooking container 3 based on the change in the magnitudes of the detection signal, that is, a faint detection signal which can not enable the heating control section 9 to actually detect the change of the infrared temperature. The first predetermined temperature is higher than a maximum temperature value optimum for cooking for fried foods (for example, 230 degrees C.), but is lower than a maximum temperature value optimum for cooking for sauteed foods (for example, 300 degrees C.). In the present embodiment, the first predetermined temperature is 250 degrees C.

As illustrated in FIG. 2, the detected temperature which is detected by the temperature detection section 11 and the infrared temperature resulted from the conversion by the infrared temperature conversion section 12 are outputted to the heating control section 9 provided under the heating coil 8. The heating control section 9 includes an inverter circuit which supplies a high-frequency electric current to the heating coil 8, and an inverter control circuit which controls a switching element in the inverter circuit to control the supply of electric power to the heating coil 8. The heating control section 9 controls the amount of the high-frequency electric current supplied to the heating coil 8, based on the detected temperature from the temperature detection section 11 and the infrared temperature from the infrared temperature conversion section 12, thereby controlling the amount of heating electric power to the cooking container 3. More specifically, the heating control section 9 determines whether or not the infrared temperature outputted from the infrared temperature conversion section 12 is equal to or higher than the first predetermined temperature, that is, whether or not the infrared sensor 10 is outputting a detection signal. If the infrared sensor 10 is outputting a detection signal, the heating control section 9 operates based on the infrared temperature outputted from the infrared temperature conversion section 12. Further, if the infrared temperature becomes equal to or higher than a second predetermined temperature, the heating control section 9 performs control in such a way as to stop the supply of electric power to the heating coil 8 or in such a way as to reduce the amount of electric power supplied thereto. If the infrared sensor 10 is not outputting a detection signal, the heating control section 9 operates based on the detected temperature outputted from the temperature detection section 11. Further, if the detected temperature is equal to or higher than a third predetermined temperature, the heating control section 9 performs control in such a way as to stop the supply of electric power to the cooking container 3 or in such a way as to reduce the amount of heating electric power.

As described above, the heating control section 9 makes comparison between the infrared temperature from the infrared temperature conversion section 12 and the second predetermined temperature or comparison between the detected temperature from the temperature detection section 11 and the third predetermined temperature, for controlling the ON/OFF of the supply of electric power to the cooking container 3 or the increase and decrease of the amount of heating electric power. The second predetermined temperature is a temperature at which the cooking container 3 is before it rises to the temperature which causes ignition of oil (about 330 degrees C.). In the present embodiment, the second predetermined temperature is 300 degrees C. In the present embodiment, the third temperature is equal to the second temperature.

The temperature detection section 11, the infrared temperature conversion section 12 and the heating control section 9 described above are constituted by circuits including a microcomputer.

The induction heating cooking device according to the present embodiment further includes a state display section 13 constituted by an LED. When the infrared sensor 10 outputs a detection signal, that is, when the temperature of the cooking container 3 is equal to or higher than the first predetermined temperature, the state display section 13 is lighted. When the infrared sensor 10 outputs no detection signal, that is, when the temperature of the bottom surface of the cooking container 3 is lower than the first predetermined temperature, the state display section 13 is extinguished. The state display section 13 is lighted or extinguished as described above, which notifies the user of the fact that the bottom surface of the cooking container 3 is at a high temperature equal to or higher than the first predetermined temperature (250 degrees C., in the present embodiment) or is not at such a high temperature.

Further, the induction heating cooking device according to the present embodiment further includes a n informing section 14 which outputs sounds. The informing section 14 changes the content of notification, based on whether the infrared sensor 10 is outputting a detection signal, and based on whether the infrared temperature from the infrared temperature conversion section 12 or the detected temperature from the temperature detection section 11 is higher than the second predetermined temperature or the third predetermined temperature. For example, when the infrared sensor 10 starts outputting a detection signal, the informing section 14 generates, through sounds, a notification describing "the pan is at a high temperature, and please take notice it", "the temperature of the pan has reached 250 degrees C." or "the temperature of the pan has reached a temperature suitable for sauteed vegetables". Thereafter, when the temperature detected by the infrared sensor 10 has become equal to or higher than the second predetermined temperature, the informing section 14 generates a notification describing "the temperature of the pan has reached a high temperature, and the heating has been temporarily stopped" or "the temperature of the pan has reached a high temperature, and the firepower has been decreased".

[Operations of Induction Heating Cooking Device]

Figure 4:
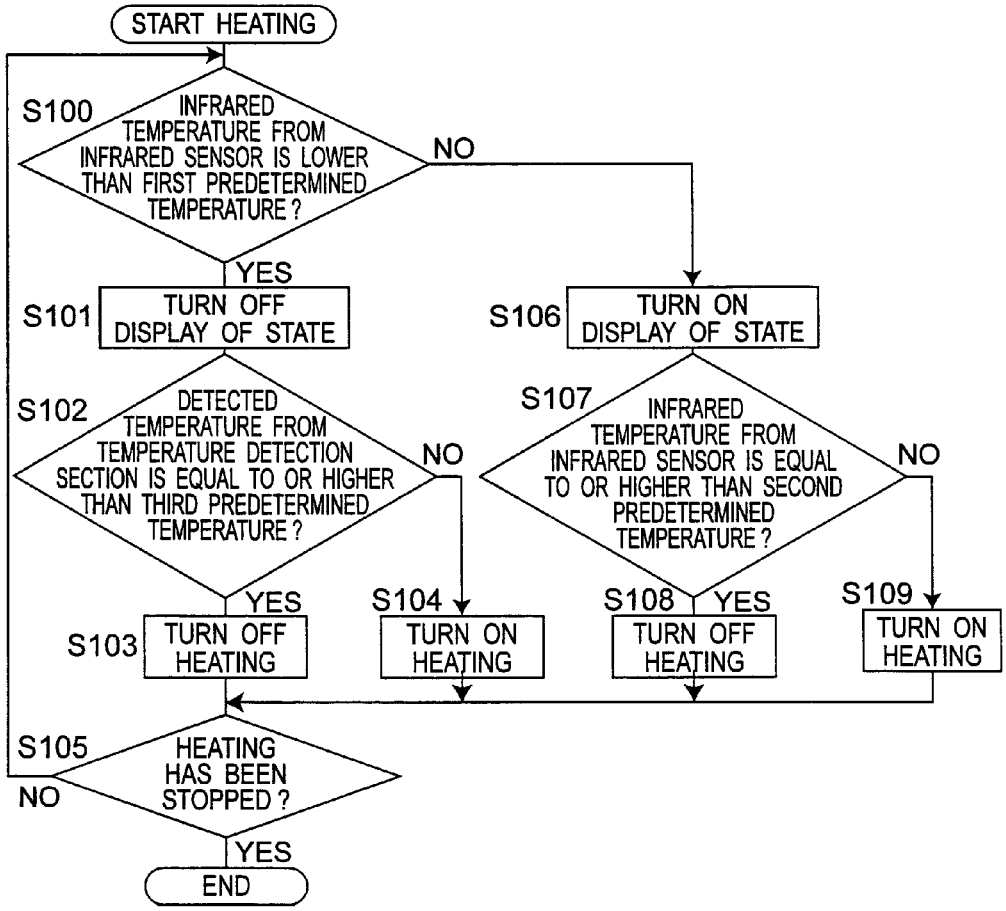
FIG. 4 is a flow chart illustrating heating control on the induction heating cooking device according to the embodiment of the present invention.

The induction heating cooking device having the aforementioned structure according to the present embodiment outputs the detection signal having output values increasing with increasing infrared temperature, when the infrared temperature from the infrared sensor 10 is equal to or higher than the first predetermined temperature set to be higher than 230 degrees C. When the infrared temperature is lower than the first predetermined temperature, the induction heating cooking device outputs no detection signal, substantially. Further, in order to prevent the cooking container 3 from being excessively heated, the infrared temperature is compared with the second predetermined temperature for turning on or off the heating of the cooking container 3 or for increasing or decreasing the amount of heating electric power. For example, when the infrared temperature outputted from the infrared temperature conversion section 12 is equal to or higher than the second predetermined temperature, the heating is temporarily stopped or the amount of electric power for heating the cooking container 3 is reduced. If the infrared temperature is dropped to below the second predetermined temperature, the heating is restarted or the amount of heating electric power is restored. When the infrared temperature is lower than the first predetermined temperature, the heating of the cooking container 3 is turned on or off or the amount of heating electric power is increased or decreased, based on whether or not the detected temperature from the temperature detection section 11 is equal to or higher than the third predetermined temperature. Hereinafter, with reference to FIG. 4, there will be exemplified a case where the ON/OFF of the heating of the cooking container 3 is controlled, by comparing the infrared temperature with the second predetermined temperature, and by comparing the detected temperature with the third predetermined temperature. FIG. 4 is a flow chart illustrating operations for controlling the heating of the induction heating cooking device according to the present embodiment. This control is performed based on programs stored in the microcomputer included in the heating control section 9.

If the user operates a switch for generating a command for starting heating of the induction heating cooking device, the heating control section 9 starts supplying a high-frequency electric current to the heating coil 8. This structure starts heating of the cooking container 3. The heating control section 9 determines whether or not the infrared sensor 10 is outputting a detection signal, that is, whether or not the infrared temperature resulted from the conversion by the infrared temperature conversion section 12 is lower than the first predetermined temperature (250 degrees C., in the present embodiment)(S100).

If the temperature detected by the infrared sensor 10 is lower than the first predetermined temperature, the heating control section 9 turns off the state display section 13 (S101). The heating control section 9 determines whether or not the detected temperature from the temperature detection section 11 is equal to or higher than the third predetermined temperature (300 degrees C., in the present embodiment) (S102). If the detected temperature from the temperature detection section 11 is equal to or higher than the third predetermined temperature, the heating control section 9 stops the supply of electric power to the heating coil 8 to turn off the heating of the cooking container 3 (S103). For example, in the event of the occurrence of a state where the infrared sensor 10 can not accurately determine the temperature of the cooking container 3 due to, for example, a failure of the infrared sensor 10, if the infrared temperature from the infrared sensor becomes lower than the first predetermined temperature, but the detected temperature based on the thermistor 15 is equal to or higher than the third predetermined temperature, the heating control section 9 turns off the heating. If the detected temperature from the temperature detection section 11 is lower than the third predetermined temperature, the heating control section 9 supplies electric power to the heating coil 8 to turn on the heating of the cooking container 3 (S104). In this case, if the heating is turned off in step S103 when the heating of the cooking container 3 has been stopped, this means that the stopping of the supply of electric power to the heating coil 8 is continued, as it now stands. If the heating is turned on in step S104 when the cooking container 3 has been heated, this means that the supply of electric power to the heating coil 8 is continued, as it now stands.

The heating control section 9 determines whether or not the user has operated a switch for generating a command for stopping the heating of the induction heating cooking device (S105). If the switch for generating a command for stopping the heating has not been operated, the heating control section 9 returns to step 100. If the switch for generating a command for stopping the heating has been operated, the heating control section 9 stops the heating of the cooking container 3.

If the temperature detected by the infrared sensor 10 is equal to or higher than the first predetermined temperature in step 100, the state display section 13 is turned on (S106). The heating control section 9 determines whether or not the infrared temperature from the infrared temperature conversion section 12 is equal to or higher than the second predetermined temperature (300 degrees C., in the present embodiment) (S107). If the infrared temperature from the infrared temperature conversion section 12 is equal to or higher than the second predetermined temperature, the heating control section 9 stops the supply of electric power to the heating coil 8 to turn off the heating of the cooking container 3 (S108). If the infrared temperature from the infrared temperature conversion section 12 is lower than the second predetermined temperature, the heating control section 9 supplies electric power to the heating coil 8 to turn on the heating of the cooking container 3 (S109). In this case, if the heating is turned off in step S108 when the heating of the cooking container has been stopped, this means that the stopping of the supply of electric power to the heating coil is continued, as it now stands. If the heating is turned on in step S109 when the cooking container 3 has been heated, this means that the supply of electric power to the heating coil is continued, as it now stands. After steps S 108 and 109, the heating control section 9 determines whether or not the switch for generating a command for stopping the heating of the induction heating cooking device has been operated (S105).

As described above, the induction heating cooking device according to the present embodiment includes the infrared sensor 10 and, when the infrared temperature is equal to or higher than 250 degrees C. (the first predetermined temperature), the infrared sensor 10 outputs the detection signal having output values increasing with increasing temperature of the bottom surface of the cooking container 3, that is, the detection signal having output values increasing with increasing quantity of energy of the detected infrared radiation.

Further, the infrared sensor 10 is structured such that it outputs no detection signal substantially, when the temperature of the bottom surface of the cooking container 3 detected by the infrared sensor 10 is lower than the first predetermined temperature. The heating control section 9 controls the ON/OFF of the heating, based on the detected temperature from the temperature detection section 11, when the temperature resulted from the conversion by the infrared temperature conversion section 12 is lower than 250 degrees C. Namely, in cases of cooking at a high temperature (280 degrees C., for example), such as in cases for cooking for sauteed foods, the heating control section 9 controls the heating, using the infrared sensor 10, while, in cases of cooking at a temperature which is not high (for example, 180 degrees C.), such as in cases of cooking for fried foods, the heating control section 9 controls the heating, based on the temperature detection section 11.

Since the ignition temperature of oil is about 330 degrees C., in cases of cooking at a temperature equal to or higher than 250 degrees C. by heating, it is necessary to perform control in such a way as to prevent the temperature of oil from reaching the ignition temperature. Particularly, in cases of using a large amount of oil, such as in cases of cooking for fried foods, the oil temperature does not abruptly rise, but, in cases of using a small amount of oil, such as in cases of cooking for sauteed, the oil temperature abruptly rises, and it is necessary to detect the rise of the oil temperature if the oil temperature abruptly rises. In the present embodiment, when the infrared temperature is equal to or higher than 250 degrees C., the ON/OFF of heating is controlled based on the infrared sensor 10 with excellent temperature followability. Accordingly, even if the oil temperature abruptly rises in cases of using a small amount of oil, it is possible to detect, immediately, the fact that the oil temperature has reached 300 degrees C. (the second predetermined temperature) before the oil temperature reaches the ignition temperature. Accordingly, it is possible to prevent the oil temperature from reaching the ignition temperature (330 degrees C., for example), by temporarily stopping the heating or reducing the amount of heating electric power. Accordingly, even in cases of cooking at a high temperature, by heating, using a small amount of oil, such as in cases of cooking for sauteed foods and the like, it is possible to perform cooking safely.

When the infrared temperature is lower than 250 degrees C., the infrared sensor 10 outputs no detection signal, which prevents the heating electric power from being reduced based on the infrared sensor 10. Further, since there is no possibility of the ignition of oil, it is possible to control the temperature of the cooking container 3 using the thermistor which has poor temperature followability but facilitates control at a stable state. A sufficiently-practical temperature adjusting function can be ensured in cases of cooking for fried foods, with an inexpensive structure, using the detection output of the thermistor 15, except for its poor followability with respect to abrupt temperature rises in the cooling container 3.

The infrared sensor 10 detects the quantity of energy of the infrared radiation emitted from a certain portion of the cooking container 3, which causes the slope of detection signal detected by the infrared sensor 10 to follow the abrupt temperature change in the cooking container 3. On the other hand, the quantity of energy of infrared radiation emitted from the cooking container 3 and the amount of change in the quantity of energy of infrared radiation with respect to the temperature change in the cooking container 3 are varied depending on the material of the cooking container 3, which makes it difficult to determine the absolute value of the temperature of the cooking container 3. For example, in the case of an infrared sensor capable of outputting a detection signal when the infrared temperature is equal to or higher than a lower temperature (for example, 50 degrees C.), it is difficult to determine the absolute value of the temperature with higher accuracy, when the temperature is a high temperature (for example, 300 degrees C.) which causes a large change in the quantity of energy. However, in the induction heating cooking device according to the present embodiment, the infrared sensor 10 is structured to output a detection signal when the infrared temperature is equal to or higher than 250 degrees C., which enables making a determination that the temperature of the cooking container is 250 degrees C. when the infrared sensor 10 starts outputting the detection signal, thereby making it easier to determine the absolute value of the temperature of the cooking container 3 around the ignition temperature of oil. Namely, it is possible to increase the detection sensitivity of the infrared sensor 10 to the temperature of the cooking container 3 around the ignition temperature of oil. Accordingly, even if the oil temperature abruptly changes in the case of using a small amount of oil, it is possible to detect, with higher accuracy, the temperature of the cooking container 3 when it is at a higher temperature before the occurrence of ignition of the oil. Accordingly, even if heating is performed with higher firepower by setting the second predetermined temperature to a high temperature which does not cause the ignition of oil, it is possible to suppress the overshoot, thereby preventing the actual oil temperature from exceeding the second predetermined temperature. This enables suppressing the temperature rise in the cooking container 3, by temporarily stopping the heating based on the infrared temperature. Accordingly, even in cases of using a small amount of oil, it is possible to set the second predetermined temperature to a high temperature which does not cause ignition of oil, thereby enabling heating for a long time while maintaining higher firepower. This enables cooking for sauteed foods with high firepower suitable for sauteed foods, by heating, for a long time. Further, since the detection sensitivity is increased, it is possible to turn off the heating before the occurrence of ignition of oil, even if the output of the heating coil 8 is increased. This enables increasing the output of the heating coil 8 for rapidly raising the temperature of the oil, in cases of cooking for fried foods and the like.

Further, the infrared sensor 10 is required only to output the detection signal when the infrared temperature is equal to or higher than 250 degrees C., which enables use of an inexpensive light receiving element capable of temperature detection only when the infrared temperature is higher, such as a silicon photodiode. Further, it is possible to easily make a determination that the temperature of the cooking container is 250 degrees C., if a detection signal is outputted. This enables simplification of the structure of the infrared temperature conversion section 12.

Further, the state display section 13 and the informing section 14 can notify the user of the fact that the temperature of the cooking container 3 is high, thereby realizing a safe induction heating cooking device capable of being used by the user with peace of mind. Further, if the state display section 13 performs display or the informing section 14 generates a notification when the temperature is not high, it is possible to recognize that the infrared sensor 10 is abnormal.

[Example of Modification]

Further, while, in the present embodiment, the heating is temporarily stopped in step 103 and step 108 in FIG. 4, the amount of electric power for heating the cooking container 3 can be reduced, without stopping the heating. In this case, in step 104 and step 109, the amount of heating electric power can be restored, that is, it can be increased.

If the infrared temperature is equal to or higher than the first predetermined temperature, it is determined that the infrared sensor 10 is normally operated and, the heating coil 8 is controlled based on the infrared sensor 10. Accordingly, due to the insertion of a cooking ingredient into the cooking container 3, the temperature of the bottom surface of the cooking container 3 is abruptly decreased, and the infrared temperature detected by the infrared sensor 10 becomes lower than the second predetermined temperature. In this case, even if the detection temperature based on the thermistor 15 with poor temperature followability is higher than the third temperature, it is possible to restore the heating electric power based on the infrared sensor 10. This enables heating the cooking ingredient at a high temperature.

Further, in the present embodiment, the first predetermined temperature is set to 250 degrees C., which is higher than 230 degrees C. but is lower than the second predetermined temperature. However, this temperature can have a value different from 250 degrees C. Further, in consideration of the variations in the circuits of the infrared temperature conversion section 12 and the heating control section 9, it is desirable that the first predetermined temperature is about 250 degrees C. (in the range of 240 to 260 degrees C.). The infrared sensor 10 does not output the detection signal during normal cooking for fried foods, which prevents the heating output from being inadvertently suppressed by the output from the infrared sensor 10.

Further, in the present embodiment, the infrared temperature conversion section 12 is provided, but the infrared temperature conversion section 12 can be eliminated. Since the infrared temperature conversion section 12 converts analog temperature information outputted from the infrared sensor 10 into digital temperature information in a different signal form, the detection signal from the infrared sensor 10 can be inputted, as temperature information, to the heating control section 9, without through the infrared temperature conversion section 12. Even in this case, similarly to in the present embodiment, the heating control section 9 can control the supply of electric power to the heating coil 8 for adjusting the temperature of the bottom surface of the cooking container 3.

Further, while, in the present embodiment, the infrared sensor 10 is provided near the center of the center opening part of the heating coil 8, the infrared sensor 10 can be placed near the inner periphery of the heating coil 8 so as to be deviated from the center of the heating coil 8. Also, a single heating coil 8 can be constituted by an inner coil and an outer coil in such a way that the heating coil 8 is partitioned into the inner coil and the outer coil, and an infrared-radiation incidence area can be formed in the top plate 2 between the inner coil and the outer coil for enabling measurement at the portion of the cooking container 3 which is positioned above the gap between the windings of the heating coil 8. With this structure, it is possible to measure the temperature at the portion of the cooking container 3 which is subjected to higher temperatures, which can suppress the temperature rise in the oil within the cooking container 3 with higher detection sensitivity. Further, it is not necessary that the thermistor 15 is placed at the upper portion at the center of the heating coil 8 as illustrated in FIG. 2. Similarly to the infrared sensor 10, the thermistor 15 can be placed in the center opening part of the heating coil 8 or between the windings in the heating coil 8 such that the thermistor 15 is deviated from the center of the heating coil 8, which can also offer similar effects as those described above.

Further, the third predetermined temperature can be made variable, not be fixed. When the infrared temperature is equal to or higher than the first predetermined temperature or equal to or higher than a fourth predetermined temperature (270 degrees C., for example), which is higher than the first predetermined temperature, the third predetermined temperature to be compared with the detected temperature from the temperature detection section 11 can be set to be a temperature higher than that when the infrared temperature is lower than the first predetermined temperature or lower than the fourth predetermined temperature. For example, when the infrared temperature is equal to or higher than the first predetermined temperature or equal to or higher than the fourth predetermined temperature, the third predetermined temperature can be set to 300 degrees C., but when the infrared temperature is lower than the first predetermined temperature or lower than the fourth predetermined temperature, the third predetermined temperature can be set to 250 degrees C. Further, in cases where the user is enabled to make selections in a cooking menu, the value of the third predetermined temperature can be varied according to the content selected in the cooking menu, as follows. Namely, when the user performs cooking with a sauteed-food setting, the third predetermined temperature can be set to 300 degrees C., while, when he or she performs cooking with a fried-food setting and with a boiled-food setting, the third predetermined temperature can be set to 160 to 230 degrees C. and 130 degrees C., respectively. Also, the third predetermined temperature can be set according to the amount of heating electric power, such that the third predetermined temperature is decreased with increasing amount of heating electric power. In the case where the third predetermined temperature is kept fixed, due to the insertion of a cooking ingredient into the cooking container 3, the temperature of the cooking container 3 may be abruptly dropped. This structure may cause the detected temperature based on the thermistor 15 with poor temperature followability to still exceed the third predetermined temperature, even if the infrared temperature from the infrared sensor 10 becomes lower than the first predetermined temperature. In this case, the heating is turned off, which prevents the temperature of the cooking container 3 from reaching a high temperature required for cooking, thereby degrading the usability in cases where cooking with higher firepower is desired. By making the third predetermined temperature variable as described above, it is possible to realize higher firepower, to address the aforementioned problem.

Also, when the temperature change based on the infrared temperature is proper and, thus, it is determined that the infrared sensor 10 functions properly, the third predetermined temperature can be set to be a temperature higher than that when the change of the infrared temperature is not proper and it is determined that the infrared sensor 10 functions improperly.

Further, in the present embodiment, when the infrared temperature based on the infrared sensor 10 is lower than the first predetermined temperature, the heating control section operates based on the detected temperature from the temperature detection section 11, and makes comparison between the detected temperature and the third predetermined temperature for stopping the heating or reducing the amount of electric power for heating the cooking container 3. However, even when the infrared temperature based on the infrared sensor 10 is not lower than the first predetermined temperature, the heating can be stopped or the amount of electric power for heating the cooking container 3 can be reduced, based on the detected temperature from the temperature detection section 11. For example, when the detected temperature based on the temperature detection section 11 is equal to or higher than the third predetermined temperature, even if the infrared temperature based on the infrared sensor 10 is not lower than the first predetermined temperature, the heating can be stopped based on the detected temperature from the temperature detection section 11. This can cause the temperature detection section 11 to have the back up function in cases where the infrared sensor 10 can not function due to failures and the like. Also, the operation for stopping the heating or suppressing the amount of electric power for heating the cooking container 3 can be performed, in cases of satisfaction of any of the condition where the infrared temperature detected by the infrared sensor 10 is equal to or higher than the second predetermined temperature and the condition where the detected temperature from the temperature detection section 11 is equal to or higher than the third predetermined temperature.

Further, in the present embodiment, the third predetermined temperature used in step S102 in FIG. 4 and the second predetermined temperature used in step 107 are equal to each other, but these temperatures can be set to be different temperatures.

Further, the state display section 13 is not limited to an LED. For example, it can be a liquid crystal.

Further, while, in the present embodiment, a silicon photodiode is used as the light receiving element in the infrared sensor 10 for detecting only higher temperatures, the light receiving element in the infrared sensor 10 can be constituted by a device capable of detecting both lower temperatures and higher temperatures. For example, the light receiving element in the infrared sensor 10 can be constituted by an element such as a PIN photodiode made of Ge (germanium) or InGaAs (indium gallium arsenide). In this case, in the infrared sensor constituted by the light receiving element and the amplifier, the amplifier can be adapted to output a detection signal when the infrared temperature is equal to or higher than the first predetermined temperature (for example, 250 degrees C.).

While the present invention has been described with respect to the particular embodiment, many other examples of variations, modifications and other uses will be apparent to those skilled in the art. Accordingly, the present invention is not limited to the disclosure herein, but is limited to the scope defined by the attached claims.

INDUSTRIAL APPLICABILITY

The induction heating cooking device according to the present invention is capable of having increased detection sensitivity to higher temperatures in cases of using a small amount of oil and therefore is applicable as a heating cooking device for cooking for sauteed foods by heating.

The invention claimed is:

1. An induction heating cooking device comprising:

a top plate that is partially or entirely made of a material capable of transmitting infrared radiation, a cooking container being placed on the top plate;

a heating coil that induction-heats the cooking container;

an infrared sensor, provided under the top plate, that detects infrared radiation which is emitted from a bottom surface of the cooking container facing the heating coil and is passed through the top plate, and that outputs a detection signal based on the quantity of energy of the detected infrared radiation; and a heating control section that controls supply of electric power to the heating coil by flowing a high-frequency electric current through the heating coil based on temperature of the bottom surface of the cooking container which is detected by the detection signal;

wherein the infrared sensor is configured to output the detection signal having output values increasing as the bottom-surface temperature increases when the temperature of the bottom surface of the cooking container is equal to or higher than a first predetermined temperature which is higher than 230 degrees C., and the infrared sensor is configured not to output the detection signal when the bottom-surface temperature is lower than the first predetermined temperature, and the heating control section reduces or stops the electric power supplied to the heating coil when the bottom-surface temperature of the cooking container detected by the infrared sensor is equal to or higher than a second predetermined temperature which is higher than the first predetermined temperature and is lower than an ignition temperature of cooking oil which is about 330 degrees C.

2. The induction heating cooking device according to claim 1, further comprising: a temperature detection section that detects the temperature of the bottom surface of the cooking container, through a heat sensitive element which receives heat transferred from an underside surface of the top plate, wherein, when the infrared sensor is outputting the detection signal, the heating control section controls the supply of electric power to the heating coil, based on the temperature of the bottom surface of the cooking container detected by the infrared sensor, such that the temperature of the bottom surface of the cooking container detected by the temperature detection section is equal to or lower than a predetermined temperature which is higher than a third predetermined temperature, and when the infrared sensor is not outputting the detection signal, the heating control section controls the supply of electric power to the heating coil such that the temperature of the bottom surface of the cooking container detected by the temperature detection section is equal to or lower than the third predetermined temperature.

3. The induction heating cooking device according to claim 1, wherein the first predetermined temperature is approximately 250 degrees C.

4. The induction heating cooking device according to claim 1, wherein the second predetermined temperature is approximately 300 degrees C.

5. The induction heating cooking device according to claim 1, further comprising a state display section that indicates whether or not the infrared sensor is outputting the detection signal, using light or a liquid crystal.

6. The induction heating cooking device according to claim 1, further comprising an informing section which, when the infrared sensor is outputting the detection signal, informs of this fact.

7. The induction heating cooking device according to claim 1, wherein the infrared sensor detects the infrared radiation, using a silicon photodiode.

* * * * *